US006121719A

United States Patent [19]

Matsutani et al.

[11] Patent Number: 6,121,719

[45] Date of Patent: Sep. 19, 2000

[54] SPARK PLUG HAVING A MULTI-LAYERED ELECTRODE

[75] Inventors: Wataru Matsutani; Hiroaki Nasu, both of Nagoya, Japan

[73] Assignee: NGK Spark Plug Co., Ltd., Nagoya, Japan

[21] Appl. No.: 09/168,150

[22] Filed: Oct. 8, 1998

[30] Foreign Application Priority Data

Nov. 20, 1997 [JP] Japan ..... 9-338066

[51] Int. Cl.[7] ..... H01T 13/20

[52] U.S. Cl. ..... 313/141; 313/142; 313/144

[58] Field of Search ..... 313/141, 142, 313/144, 143, 145; 445/7; 123/169 R, 169 EL

[56] References Cited

U.S. PATENT DOCUMENTS

| | | | |
|---|---|---|---|
| 5,210,457 | 5/1993 | Oshima et al. | 313/11.5 |
| 5,461,275 | 10/1995 | Oshima | 313/141 |
| 5,530,313 | 6/1996 | Chiu | 313/141 |
| 5,866,973 | 2/1999 | Kagawa et al. | 313/141 |

FOREIGN PATENT DOCUMENTS

| | | |
|---|---|---|
| 0 474 351 B1 | 3/1992 | European Pat. Off. . |
| 4-43585 | 2/1992 | Japan . |
| 4-104490 | 4/1992 | Japan . |
| 5-315050 | 11/1993 | Japan . |
| 6-48630 | 6/1994 | Japan . |

*Primary Examiner*—Nimeshkumar D. Patel
*Assistant Examiner*—Mariceli Santiago
*Attorney, Agent, or Firm*—Morgan, Lewis & Bockius LLP

[57] ABSTRACT

A spark plug has a central electrode, an insulator, a metal shell and a ground electrode. The insulator is provided exterior to the central electrode. The metal shell is provided exterior to the insulator. The ground electrode opposes the central electrode. At least one of the central electrode and the ground electrode has a multi-layered structure comprising a core and a high heat conducting layer that covers at least part of the outermost surface of the core. An inner layer of the core is more heat conductive than the outermost layer of the core that is in contact with high heat conducting layer.

12 Claims, 12 Drawing Sheets

SPARK PLUG HAVING A MULTI-LAYERED ELECTRODE

BACKGROUND OF THE INVENTION

1. Field of the Invention

The present invention relates to a spark plug for use in internal combustion engines.

2. Description of the Related Art

As the performance of recent automotive and other internal combustion engines has improved, the temperature of spark plugs used to start the engines has increased. With increased spark plug temperatures, the spark gap formed between electrodes tend to be consumed at an accelerated rate and the endurance of the spark plug is shortened accordingly. In order to ensure corrosion resistance at high temperatures, spark plug electrodes are often made of Ni alloys such as Inconel. However, Ni alloys are generally low in thermal conductivity and permit heat dissipation at such a slow rate that the electrode temperature is prone to rise unduly during high speed driving and other operations. In order to solve this problem, a spark plug has been commercialized, in which the heat dissipation and endurance of the electrode are improved by using a core electrode member made of a high heat conducting core metal, such as a Cu-based metal.

The behavior of thermal conduction in the radial direction of an electrode in a spark plug 200 is shown in FIG. 13A. A temperature gradient is formed from the peripheral surface P1 of the electrode 200 (which may be regarded as the "heat input side") to the center. This gradient provides a driving force for the progress of heat conduction. The electrode 200 is structured such that a high heat conducting core metal 202, which serves to accelerate heat dissipation, is located in the central area of the electrode 200. Externally applied heat Q is unable to flow into the high heat conducting core metal 202 until after it passes through an sheath portion 201, which has a comparatively small heat transfer coefficient. In other words, the heat transfer through the sheath portion 201 is a rate limiting step in the behavior of heat dissipation under consideration. If the thickness of the sheath portion 201 is excessive, the heat flux through the core member 202 is reduced as shown in FIG. 13B, and the heat dissipation that can be achieved is not as great as intended. Therefore, in order to ensure effective heat dissipation, the relative thickness of the sheath portion 201 as compared to the core member 202 must be reduced. Conversely stated, the radial dimension of the high heat conducting core metal 202 has to be significantly increased.

However, if the dimension of the core member 202 is made too large, an elevation in the electrode temperature causes the production of a higher level of thermal stress due to the difference in linear expansions between the sheath portion 201 and the core member 202. This may potentially lead to interlaminar cracking and expansion electrode problems. These problems are most likely to occur in direct-injected gasoline engines and other engines of a type in which the firing portions of a spark plug project into the combustion chamber resulting in a considerably high electrode temperature. Since the increase in the dimension of the core member 202 is limited to a certain degree by the generation of thermal stress, the desired improvement in heat dissipation has not been achieved to the fullest extent.

SUMMARY OF THE INVENTION

It is therefore an object of the present invention to provide a spark plug that employs electrodes having a multi-layered structure for improving heat dissipation and suppressing the generation of thermal stress in the electrodes, to thereby reduce the occurrence of interlaminar cracking and expansion in the electrodes.

A spark plug according to the present invention has a central electrode, an insulator, a metal shell and a ground electrode. The insulator is provided exterior to the central electrode. The metal shell is provided exterior to the insulator. The ground electrode opposes the central electrode. At least one of the central electrode and the ground electrode has a multi-layered structure comprising a core and a high heat conducting layer that covers at least part of the outermost layer of the core. An inner layer of the core is made of a more heat conductive material than the outermost layer of the core that is in contact with the high heat conducting layer. The thickness of the good heat conductor layer is within a range of 0.03 to 0.3 mm. Alternatively, the outside of the good heat conductor layer may be covered with an outer coating layer made of a material that is more corrosion-resistant than the high heat conducting layer, and the thickness of the outer coating layer may be within a range of 0.05 to 0.2 mm.

DETAILED DESCRIPTION OF THE INVENTION

A spark plug according to a first aspect of the invention has a central electrode, an insulator provided exterior to the central electrode, a main metal shell provided exterior to the insulator and a ground electrode opposing the central electrode. In the spark plug, at least one of the central electrode or the ground electrode has a multi-layered structure. (The central electrode and the ground electrode are hereinafter sometimes collectively referred to as "electrode".) The multi-layered structure has a core and a high heat conducting layer that covers at least part of the surface of the core. The innermost layer of the core is made of a more heat conductive material than the outermost layer of the core which is in contact with the high heat conducting layer. The thickness of the high heat conducting layer is within the range of 0.03 to 0.3 mm.

Figure 3A:
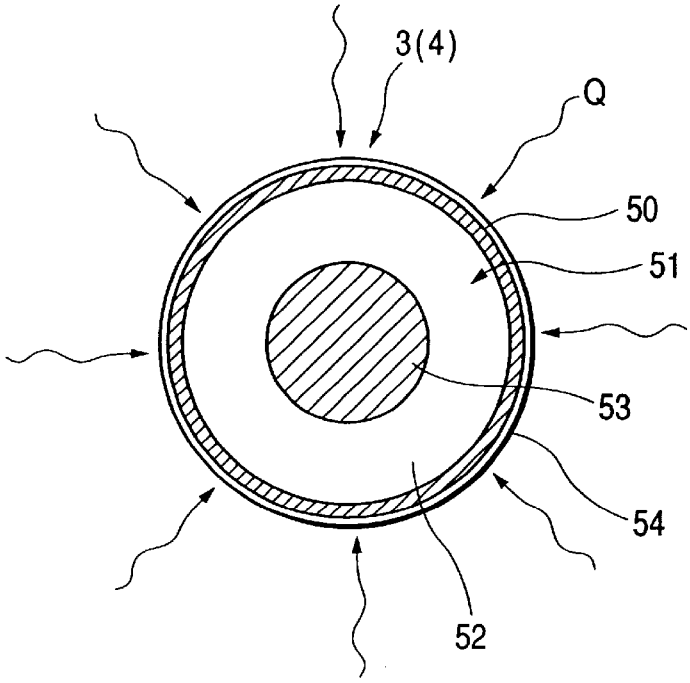
FIGS. 3A and 3B illustrate the operational function of the electrode structure in the spark plug.
Figure 3B:
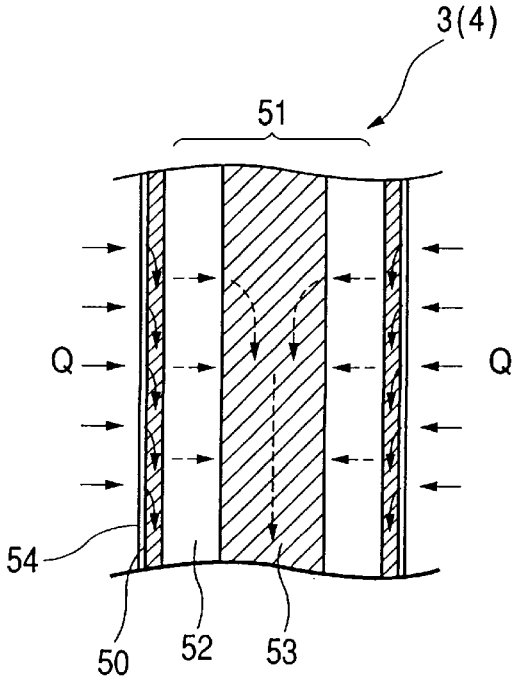
Figure 13A:
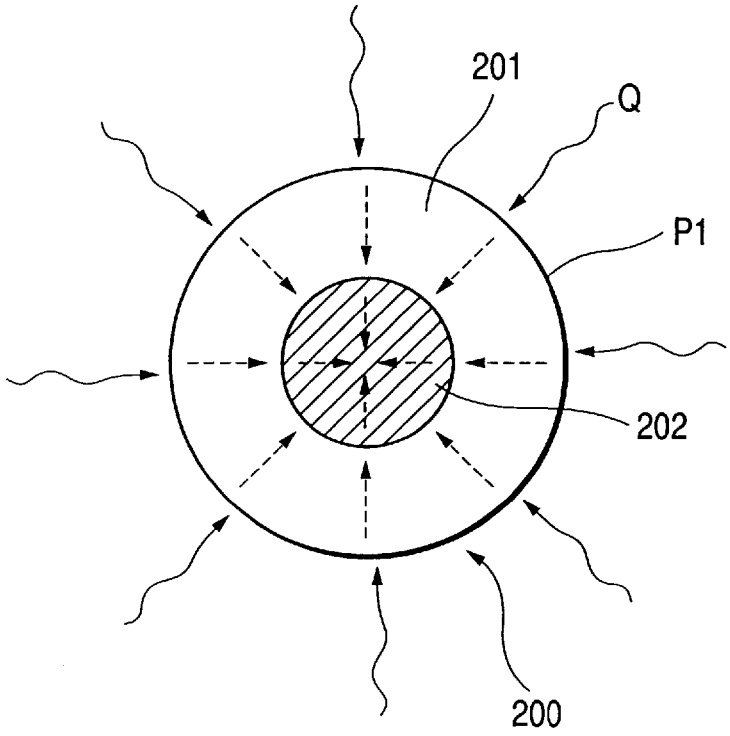
FIGS. 13A and 13B illustrate how the electrodes in the related spark plug operate to exhibit their functions.
Figure 13B:
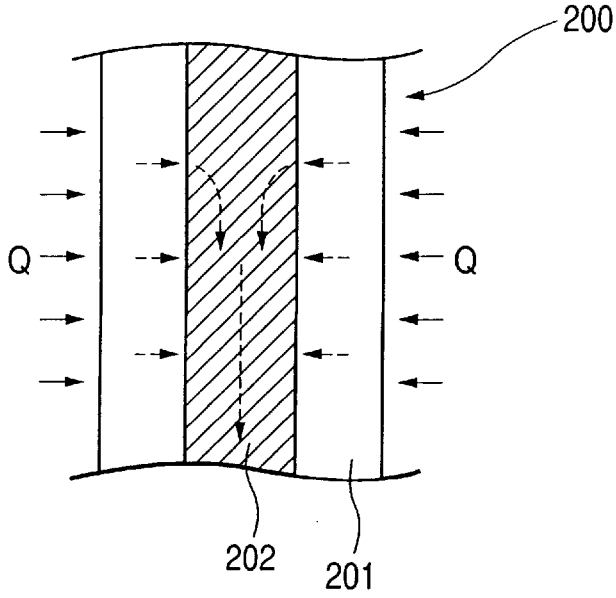

The spark plug of the present invention has a structure that is contrary to the related spark plug having an electrode in which a high heat conducting core metal is arranged inside an outer coating. Namely, in the present invention, the surface of the core member is covered with the good heat conducting layer. Accordingly, the electrodes of the present invention permit by far more efficient heat dissipation (i.e., heat dissipation) than those in the related spark plug of FIGS. 13A and 13B. In case of considering the incoming and outgoing heat path as similar to them shown in FIGS. 13A and 13B, as shown in FIGS. 3A and 3B, the electrodes 3 and 4 of the spark plug of the invention have the surface of a core 51 covered with a high heat conducting layer 50. In other words, the high heat conducting layer 50 is provided on the surface layer of the electrode 3 (or 4), or at a position close to the surface layer. As a result, the transfer of external heat Q to the high heat conducting layer 50 is accomplished with improved efficiency to accelerate heat dissipation. Even if the electrodes are exposed to elevated temperatures due to, for example, an engine operation under a high load and at a high speed, the electrode consumption is effectively suppressed to extend the operating endurance of the spark plug. As a further advantage, the intended effect of heat dissipation can be attained even if the high heat conducting layer 50 does not have a very large thickness. Hence, the thermal stress due to linear expansion differences between the high heat conducting layer 50 and the core 51 can be held at a sufficiently low level, and interlaminar cracking and expansion electrode problems are less likely to occur.

The high heat conducting layer 50 can be formed using any one of Cu, Ag, Au and Ni as a main component. Considering the balance between heat conductivity and cost, a Cu or Cu alloy is preferable. If a Ni-based metal is to be used, it is preferable to employ materials of the highest possible Ni content (e.g., those nearly equivalent to the elemental Ni metal) in order to ensure that the materials have comparable heat transfer coefficients to other applicable materials.

In the spark plug according to the first aspect of the present invention, the thickness of the high heat conducting layer 50 is within the range of 0.03 to 0.3 mm. If the thickness of the high heat conducting layer 50 is less than 0.03 mm, the intended effect of heat dissipation might not be attained. On the other hand, if the thickness of the high heat conducting layer 50 exceeds 0.3 mm, the level of thermal stress due to the linear expansion difference (to be described below) which occurs between the core 51 and the high heat conducting layer 50 increases to a higher level.

For example, if the core 51 has a smaller linear expansion coefficient than the high heat conducting layer 50 (as in the case where at least the outermost layer of the core 51 is made of Ni or a Ni alloy whereas the high heat conducting layer 50 is made of Cu or a Cu alloy), defects such as expansion electrodes and delamination might occur. Except Ni-based metals, the above-mentioned materials for the high heat conducting layer 50 do not have very high strength. Hence, considering the dimensions of the electrodes in common spark plugs (which are about 3 to 5 $mm^2$ in terms of an axial cross-sectional area), increasing the thickness of the high heat conducting layer 50 beyond 0.3 mm is not preferred from the viewpoint of insuring the overall strength of the electrodes. More desirably, the thickness of the high heat conducting layer 50 is within the range of 0.1 to 0.25 mm.

If desired, the outside of the high heat conducting layer 50 may be covered with an outer coating layer made of a material that is more corrosion-resistant than the high heat conducting layer 50. This helps to prevent the high heat conducting layer 50 from being consumed by corrosion at elevated temperatures or spark discharge, thus contributing to further improving the durability of the electrodes. The thickness of the outer coating layer is preferably within the range of 0.05 to 0.3 mm. If the thickness of the outer coating layer is less than 0.05 mm, the intended effectiveness in imparting corrosion resistance might not be achieved. If the thickness of the outer coating layer exceeds 0.3 mm, the heat conduction through the outer coating layer becomes a rate-limiting step and the heat transfer into the high heat conducting layer 50 may be restrained to cause occasional failure in achieving intended heat dissipation. More desirably, the thickness of the outer coating layer is within the range of 0.05 to 0.2 mm, and most desirably within the range of 0.05 to 0.15 mm.

Alternatively, the outside of the high heat conducting layer 50 may be covered with an outer coating layer made of a material having a smaller linear expansion coefficient than the high heat conducting layer 50. Accordingly, it is possible to suppress the excessive expansion of the high heat conducting layer 50, and to further prevent the occurrence of electrode expansion and delamination between the high heat conducting layer 50 and the core 51. In order to ensure the intended heat dissipation, it is recommended that the thickness of the outer coating layer be also be no more than 0.3 mm, preferably 0.2 mm or less, and more preferably 0.15 mm or less. The lower limit of the thickness of the outer coating layer should be appropriate for the difference between the linear expansion coefficients of the outer coating layer and the high heat conducting layer 50, to thereby ensure that the outer coating layer can effectively prevent defects, such as expansion of the electrodes.

The outer coating layers described above may be mainly composed of Ni alloys. If the high heat conducting layer 50 is made of Cu or a Cu alloy or Ag or an Ag alloy, the outer coating layer will have a smaller linear expansion coefficient than the high heat conducting layer 50. If the high heat conducting layer 50 is made of metallic Cu or a Cu alloy, the outer coating layer also exhibits high corrosion resistance at elevated temperatures. In view of the above-described combination of the high heat conducting layer 50 and the outer coating layer, it is recommended that the thickness of the high heat conducting layer 50 be within the range of 0.03 to 0.3 mm, and preferably 0.1 to 0.25 mm, and the thickness of the outer coating layer be within the range of 0.05 to 0.3 mm, preferably 0.05 to 0.2 mm, and more preferably 0.05 to 0.15 mm. For the criticalities of the upper and lower limits of the thickness of the high heat conducting layer 50 and the criticality of the upper limit of the thickness of the outer coating layer, see the foregoing discussion. If the thickness of the outer coating layer is less than 0.05 mm, it is not necessarily effective in suppressing the expansion of the high heat conducting layer 50, occasionally causing the aforementioned problems of expansion electrodes and delamination.

The spark plug according to the second aspect of the invention has a central electrode, an insulator provided exterior td the central electrode, a main metal shell provided exterior to the insulator and a ground electrode opposing the central electrode. In the spark plug, at least one of the central electrode and the ground electrode has a multi-layered structure. The multi-layered structure has a core and a high heat conducting layer that covers at least part of the surface of the core. The material of the inner portion of the core is more heat conductive than the outermost layer of the core that is in contact with the high heat conducting layer. The outside of the high heat conducting layer is covered with an outer coating layer made of a material that is more corrosion-resistant than the high heat conducting layer. The thickness of the outer coating layer is within the range of 0.05 to 0.2 mm.

The core forms an essential part of the electrodes, and its constituent material is preferably selected so that the desired strength can be imparted to the electrodes. The core may be designed to have a single-layered structure. However, if the thermal stress that develops due to the thermal expansion difference between the core and the high heat conducting layer becomes a significant problem, the linear expansion coefficient of the core taken as a whole should be adjusted to reduce this linear expansion difference. In order to meet this requirement, the core may have a structure in which a plurality of layers are arranged so that adjacent layers have different linear expansion coefficients.

In this case, at least one of the constituent layers of the core, except for the outermost layer, may be an internal high heat conducting layer that is made of a more heat conductive material than the outermost layer. Specifically, the outermost layer of the core may be made of Ni or a Ni alloy, whereas the internal high heat conducting layer may be made of Cu or a Cu alloy or Ag or a Ag alloy. With this arrangement, the heat dissipating effect of the internal high heat conducting layer combines with that of the first mentioned high heat conducting layer to improve the endurance of the electrodes and, hence, the spark plug.

Whichever of the ground electrode and the central electrode has a multi-layered structure is hereinafter referred to as a "multi-layered electrode." If the multi-layered electrode has an axial cross-sectional area of S1, and the internal high heat conducting layer has an axial cross-sectional area of S2, a region where S2/S1 is less than 0.13 is hereinafter referred to as an "internal high heat conducting layer deficient region." The internal high heat conducting layer deficient region is formed in a specified length in the forward end portion of the multi-layered electrode. Further, L/D is at least 0.55, where L is the length of the internal high heat conducting layer deficient region and D is the dimension in axial cross-section of the multi-layered electrode in the area where the internal high heat conducting layer deficient region is present.

The aforementioned parameters are accurate provided that the multi-layered electrode has a circular cross-section, and the dimension in axial cross-section is the diameter of the circle. If the electrode has a non-circular cross-section, an equivalent diameter is the diameter of a circle having the same area as that non-circular cross-section.

According to the studies conducted by the present inventors, it has been found that if S2/S1 is less than 0.13, the internal high heat conducting layer is not expected to greatly accelerate heat dissipation. For example, if the internal high heat conducting layer in the forward end portion of the multi-layered electrode is interrupted midway in the axial direction, no profile of that internal layer will appear within the axial cross-section of the electrode tip.

Alternatively, even if such a profile appears, the region where S2/S1 is less than 0.13, which is deficient in the internal high heat conducting layer, will be formed in a specified length. If the internal high heat conducting layer is tapered toward the electrode tip, one may safely conclude that the portion of its axial length where S2/S1 is at least 0.13 proves effective in accelerating heat dissipation.

If the internal high heat conducting layer is formed of Cu-based metals and other materials that are somewhat low in strength, it is preferable to form the internal high heat conducting layer deficient region so that L/D is at least 0.55. This ensures the strength of the multi-layered electrode.

The related spark plug does not have the high heat conducting layer near the surface layer of the electrodes. As a result, if the length of the internal high heat conducting layer deficient region is long, the heat dissipation from the area of each electrode which is near the spark discharge gap where heat dissipation should take place at the most accelerated speed is so restrained that the endurance of the electrodes tends to be shortened. In contrast, in the spark plug of the present invention, the heat dissipation from the first mentioned high heat conducting layer ensures that the heat dissipation from the internal high heat conducting layer deficient region is sufficiently promoted to prolong the endurance of the electrodes and, hence, their firing portions.

Preferred embodiments according to the present invention will now be described while referring to the accompanying drawings.

Figure 1A:
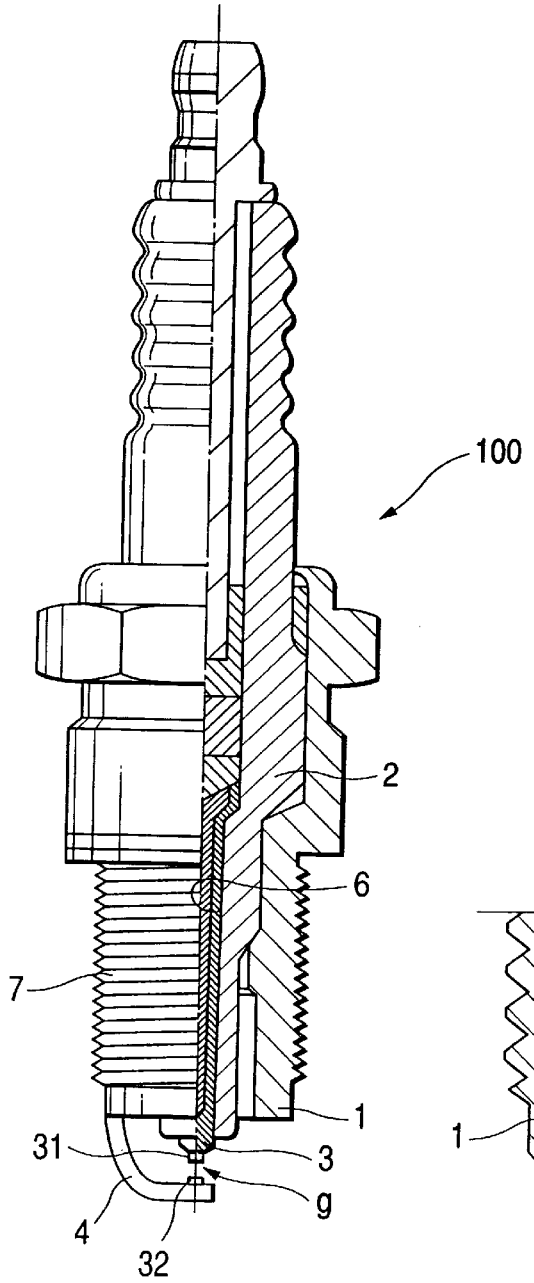
FIG. 1A is a front sectional view of a spark plug according to an embodiment of the invention.
Figure 1B:
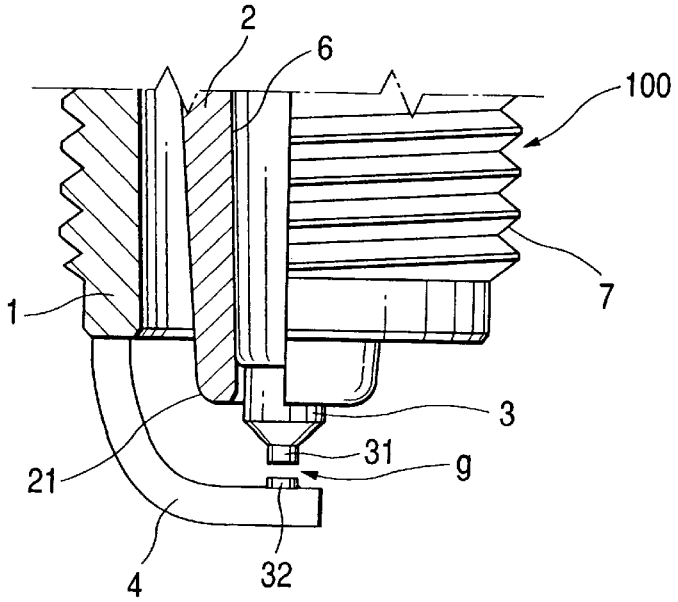
FIG. 1B is a partial front sectional view of FIG. 1A.

FIG. 1A shows a spark plug according to an embodiment of the invention. FIG. 1B is a partial enlarged view of FIG. 1A. The spark plug 100 is constituted by a tubular main metal shell 1, and insulator 2, a central electrode 3, a ground electrode 4 and the like. The insulator 2 is fitted within the main metal shell 1 and has a tip 21 projecting from the body 1. The central electrode 3 is provided within the insulator 2 in such a way that a firing portion 31 formed at the tip projects from the insulator 2. The ground electrode 4 is welded or otherwise joined at an end to the main metal shell 1 with the other end being bent laterally so that its lateral side will face the tip of the central electrode 3. The ground electrode 4 also has a firing portion 32 facing the firing portion 31 of the central electrode 3. The clearance between the opposing firing portions 31 and 32 provides a spark discharge gap g.

The insulator 2 is made of a sinter of ceramic materials such as alumina or aluminum nitride, and it has a bore 6 through which the central electrode 3 is fitted along its own axis. The main metal shell 1 is a cylinder formed from a metal such as a low-carbon steel, and provides a housing for the spark plug 100. A thread portion 7 is formed on the periphery of the main metal shell for assisting in the installation of the spark plug 100 in an engine block (not shown).

Figure 2A:
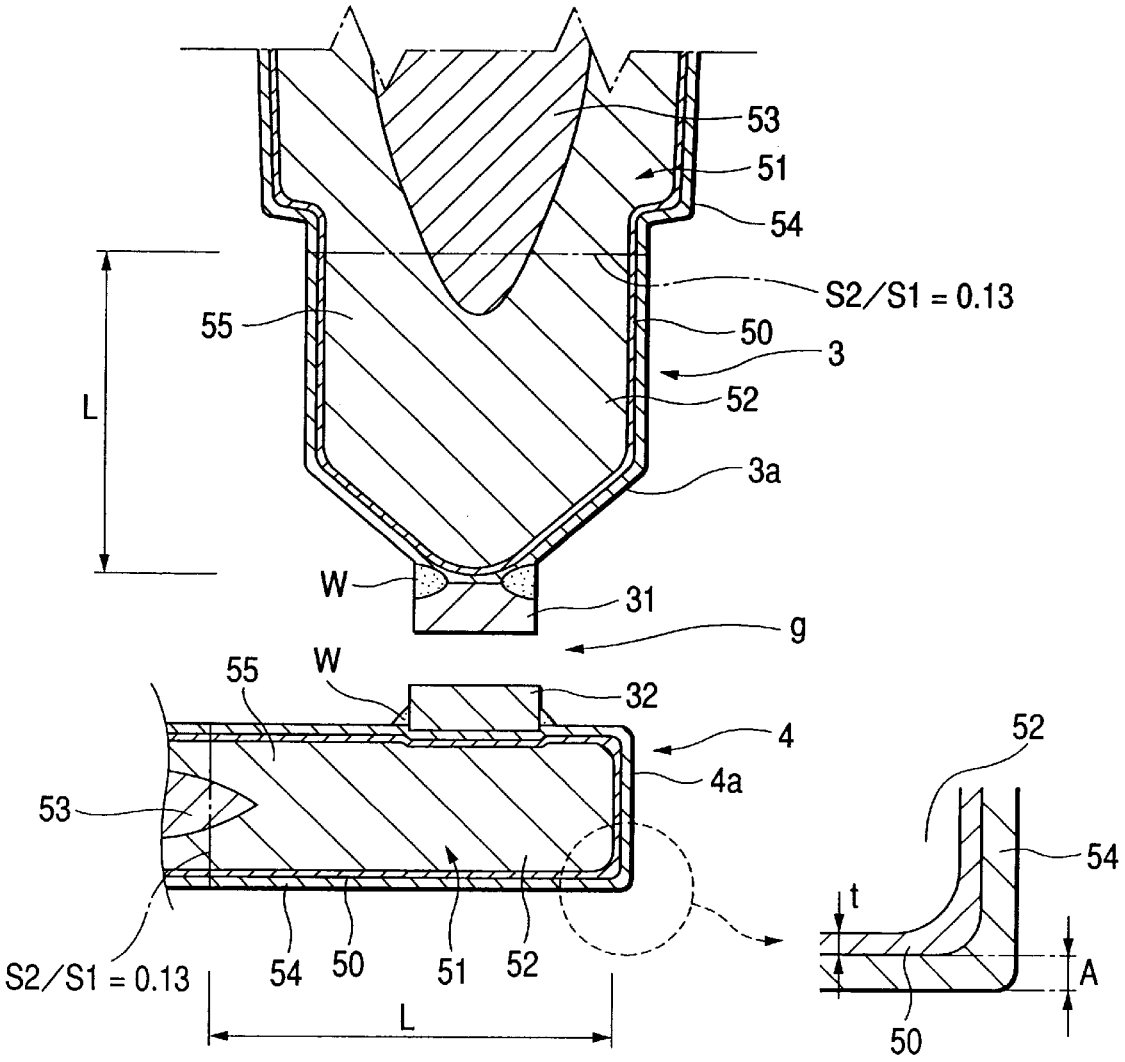
FIGS. 2A and 2B show enlarged essential parts of the spark plug in section.

FIG. 2A shows the body 3*a* of the central electrode 3 and the body 4*a* of the ground electrode 4. Each body has a multi-layered structure having a core 51, a high heat conducting layer 50, and an outer coating layer 54. The high heat conducting layer 50 covers the surface of the core 51, and is made of a more heat conductive material than the outermost layer 52 of the core 51 in contact with the high heat conducting layer 50. The outer coating layer 54 covers the outside of the high heat conducting layer 50. The high heat conducting layer 50 may be formed of Cu or a Cu alloy, and its thickness is within the range of 0.03 to 0.3 mm, preferably 0.1 to 0.25 mm. The outer coating layer 54 is formed of a Ni alloy such as Inconel or Hastelloy, and its thickness is within the range of 0.05 to 0.3 mm, preferably 0.05 to 0.2 mm, and more preferably 0.05 to 0.15 mm.

The outermost layer 52 of the core 51 in its axial cross-section is made of a Ni alloy such as Inconel or Hastelloy. An internal high heat conducting layer 53 of the core 51 is made of Cu or a Cu alloy, and is formed as a core inside the outermost layer 52. The internal high heat conducting layer 53 is interrupted midway in the axial direction of the tip of each of the cores 51 of the central electrode 3 and the ground electrode 4.

The body 3*a* of the central electrode 3 is tapered toward its tip and its end face is flat. A disk of noble metal tip made of an Ir alloy (typical compositions of which will be described below) or a Pt alloy (e.g. Pt-20 wt % Ni alloy) is superposed on the flat face of the body 3*a*. A weld zone W is formed along the outer edges of the joint by laser welding, electron beam welding, resistance welding or some other welding technique. Consequently, the noble metal tip is secured in position to form the firing portion 31. To form the opposing firing portion 32, a suitable noble metal tip is positioned on the ground electrode 4 in registry with the firing portion 31. Also, a weld zone W is similarly formed along the outer edges of the joint, so that the noble metal tip is secured in position.

Figure 4A:
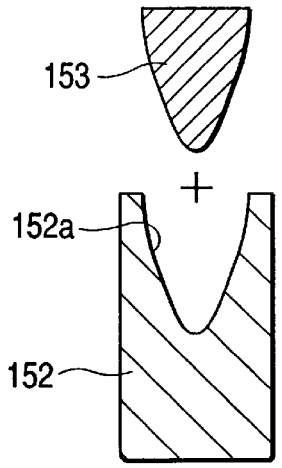
FIGS. 4A to 4F show the sequence of steps in an exemplary process for producing an electrode.
Figure 4B:
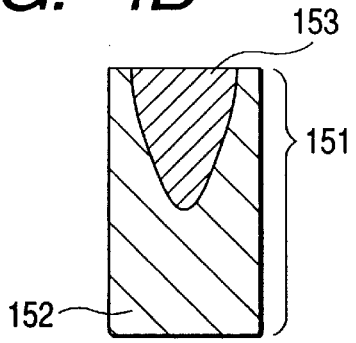
Figure 4C:
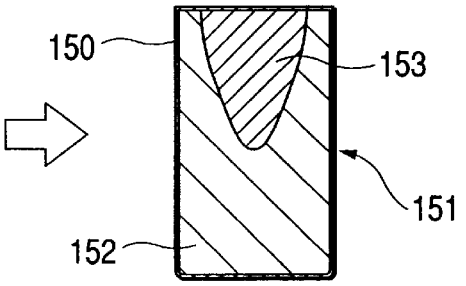

FIGS. 4A to 4F illustrate an exemplary process for producing the body 3*a* of the central electrode 3 and the body 4*a* of the ground electrode 4. As shown in FIG. 4A, a first Ni-base preformer 152 having a recess 152*a* is prepared from a Ni or Ni alloy stock by a cutting or plastic working method such as deep drawing. A Cu-base preformer 153 separately prepared by cutting or some other method is then fitted into the recess 152*a* to prepare an assembly for the core that is indicated by 151 in FIG. 4B. Then, as shown in FIG. 4C, a Cu plate layer 150 is formed over the outer surfaces of the assembly 151 by a chemical plating method (e.g., electroplating) or a vapor-phase film deposition method (e.g., vacuum evaporation or sputtering).

Figure 4D:
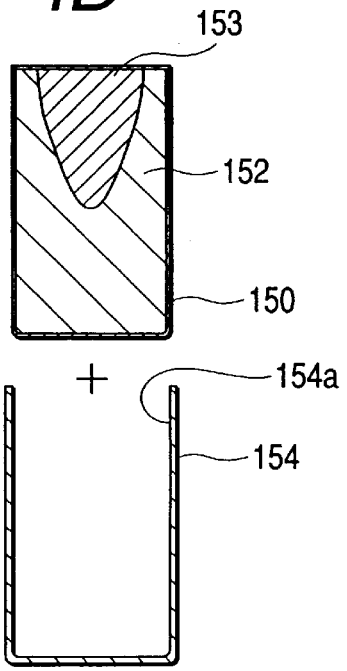
Figure 4E:
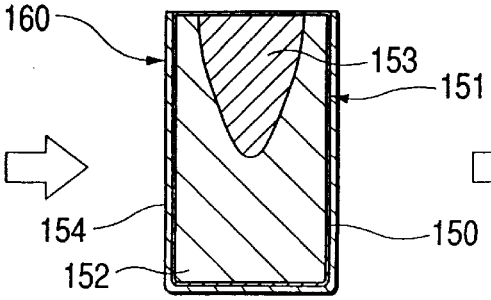
Figure 4F:
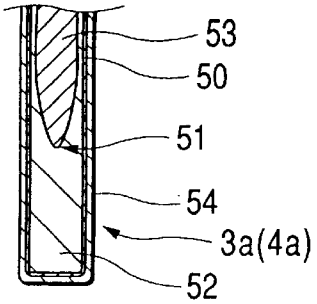

Subsequently, as shown in FIG. 4D, the assembly 151 with the Cu plate layer 150 is fitted into a recess 154*a* in a second Ni-base preformer 154 (which is separately prepared by the same method as the first Ni-base preformer 152), thereby producing an assembly for electrode working which is indicated by 160 in FIG. 4E. The assembly 160 is then subjected to plastic working such as rotary forging (i.e., swaging) so that it is stretched axially to yield the body 3*a* or 4*a*. During the process, the assembly for the core 151 consisting of the Cu-base preformer 153 and the first Ni-base preformer 152 provides the core 51 consisting of the internal high heat conducting layer 53 and the outermost layer 52. The Cu plate layer 150 provides the high heat conducting layer 50, and the second Ni-base preformer 154 provides the outer coating layer 54 See FIG. 4F.

Figure 5A:
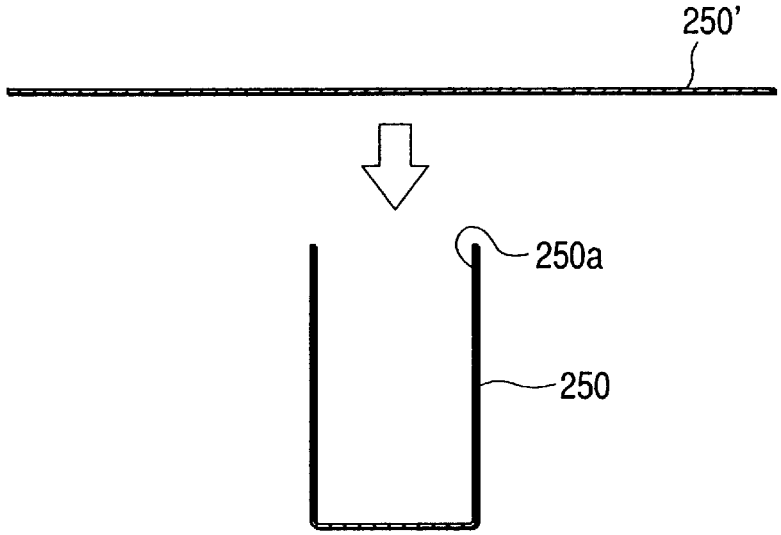
FIGS. 5A to 5B show the sequence of steps in a modified process for producing an electrode.
Figure 5B:
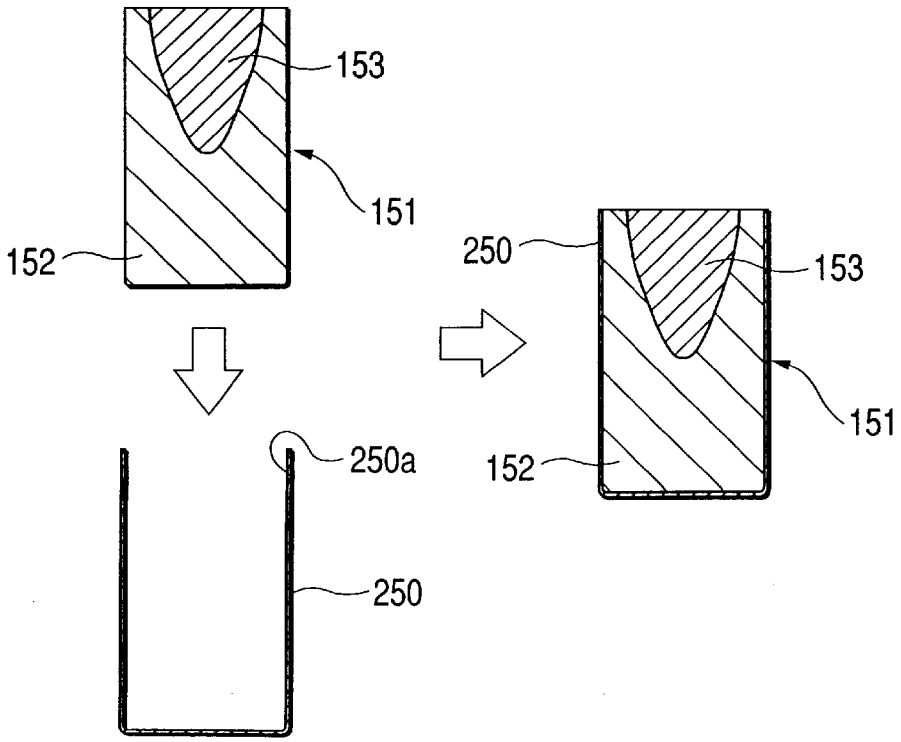

FIGS. 5A and 5B show an alternative method for covering the outer surfaces of the assembly for the core 151 with the Cu plate layer 150. A stock plate 250' of metallic Cu or a Cu alloy (which may be replaced by a stock screen such as a Cu mesh) in FIG. 5A is subjected to deep drawing, thereby making a Cu-base preformer 250 having a recess 250*a*. Thereafter, the assembly for the core 151 is fitted into the recess 250*a* as shown in FIG. 5B. In this alternative case, the Cu-base preformer 250 provides the high heat conducting layer 50.

A description concerning the operation of the spark plug 100 will now be given. That is, the spark plug 100 as shown in FIGS. 1A and 1B is installed in an engine block by means of engagement of the thread portion 7, and is used as a source for igniting the air/fuel mixture gas supplied into the combustion chamber.

When the engine operates under high load and at high speed, the temperature in the area near the spark gap g of the spark plug 100 is so elevated that the firing portion 31 of the central electrode 3 and the opposing firing portion 32 of the ground electrode 4 are both exposed to a hostile environment in which those firing portions are likely to be consumed. However, both electrodes have a structure such that the surface of the core 51 is covered with the high heat conducting layer 50 (see FIG. 3A) and the external heat Q is efficiently transferred to the high heat conducting layer 50, thereby accelerating the heat dissipation. As a result, the consumption of the firing portions 31 and 32 is sufficiently suppressed to thereby prolong the endurance of the spark plug 100.

As a further advantage, the intended heat dissipation can be achieved without increasing the thickness of the high heat conducting layer 50 to a significant value. Hence, the thermal stress due to the difference in linear expansion between the high heat conducting layer 50 and the core 51 can be controlled to a sufficiently small level so that interlaminar cracking and expansion electrodes are less likely to occur.

The outside of the high heat conducting layer 50, which is made of Cu or a Cu alloy, is covered with the outer coating layer 54, which is made of a Ni alloy that is more corrosion-resistant but has a smaller linear expansion coefficient than the Cu or Cu alloy. This arrangement is effective in preventing the consumption of the high heat conducting layer 50 due to corrosion at elevated temperatures. What is more, the excessive expansion of the high heat conducting layer 50 can be controlled by the outer coating layer 54 and the problems of expansion electrodes and delamination between the high heat conducting layer 50 and the core 51 become even less likely to occur.

Figure 2B:
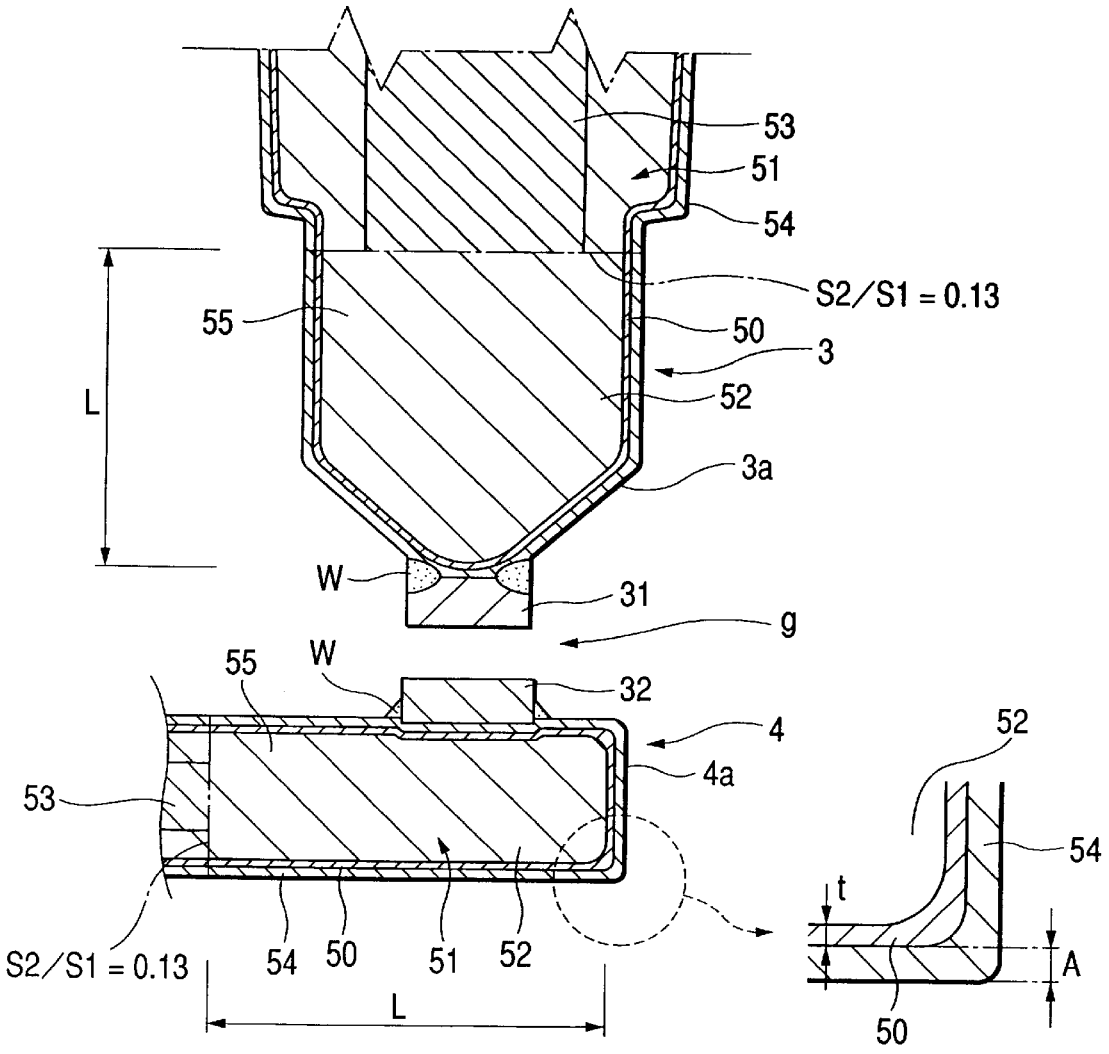

The internal high heat conducting layer 53 in each of the central electrode 3 and the ground electrode 4 may be tapered toward its tip. The electrodes 3 and 4 are more subject to heat in the areas that are closer to the tip. However, by tapering the forward end portion of the internal high heat conducting layer 53, which is made of Cu or some other metallic material having large linear expansion coefficient, the problems of electrode expansion and the delamination between the layer 50 and the core 51 are less likely to occur. When the electrodes 3 and 4 are produced by rotary forging (or drawing through a die) of the assembly 160 (see FIGS. 4A to 4F), the material tends to advance more rapidly in the central portion than in the other portions. As a result, the forward end portion of the internal high heat conducting layer 53 may sometimes be tapered as a natural consequence. Alternatively, as shown in FIG. 2B, the internal high heat conducting layer 53 in each of the central electrode 3 and the ground electrode 4 is tapered toward its tip in the present invention.

When the tapered portion is formed in the internal high heat conducting layer 53, the smaller the axial cross-sectional area of the electrode, and the less effective it is in accelerating heat dissipation. According to the studies conducted by the present inventors, it has been found that if S2/S1 is less than 0.13, the internal high heat conducting layer 53 is not expected to greatly accelerate heat dissipation. (As discussed above, S1 is the axial cross-sectional area of the electrode 3 or 4, and S2 is the axial cross-sectional area of the internal high heat conducting layer 53; see FIG. 2A.) Therefore, one may safely conclude that the portion of the axial length of the internal high heat conducting layer 53 where S2/S1 is at least 0.13 or more proves effective in accelerating heat dissipation.

For example, take the case in which the internal high heat conducting layer 53 in the forward end portion of the central electrode 3 or the ground electrode 4 is interrupted midway in the axial direction. In such a case, no profile of that internal layer will appear within the axial cross-section of the electrode tip. Alternatively, even if such a profile appears, the region 55 where S2/S1 is less than 0.13 and which is deficient in the internal high heat conducting layer will be formed in a specified length.

As shown in FIG. 2A, the length of the region 55 is assumed to be L, and the dimension of the axial cross-section of the electrode 3 or 4 in the area where the region 55 is present is assumed to be D. These measurements are accurate provided that the electrode has a circular cross-section, and the dimension in axial cross-section is the diameter of the circle. If the electrode has a non-circular cross-section, an equivalent diameter is the diameter of a circle having the same area as that non-circular cross-section. In this case, L/D is preferably set to be at least 0.55 for both the central electrode 3 and the ground electrode 4. If necessary, the internal high heat conducting layer 53 may be extended further closer to the electrode tip up to the position where L/D is less than 0.55. In other words, the length L of the region 55 which is deficient in the internal high heat conducting layer is shortened. However, the internal high heat conducting layer 53 which is made of metallic Cu or a Cu alloy is somewhat weaker than the metallic Ni or Ni alloy which are the constituent material of the outermost layer 52. Therefore, one may safely conclude that forming the region 55 in such a way that L/D is at least 0.55 is preferable in order to ensure the strength of the electrodes 3 and 4.

As already mentioned, increasing the length of the region 55 which is made of Ni-base materials that are less heat conductive than Cu-base materials has not been necessarily preferred for the related spark plug. This is because heat dissipation from the area of each electrode which is near the spark discharge gap where heat dissipation should take place at the most accelerated speed is so restrained that the endurance of the electrodes (or their firing portions) tends to be shortened. In contrast, in the spark plug of the present invention, the heat dissipation from the high heat conducting layer 50 formed near the surface layer of each of the electrodes 3 and 4 ensures that the heat dissipation from the region 55 which is deficient in the internal high heat conducting layer is sufficiently promoted, thereby prolonging the endurance of the electrodes or their firing portions.

As shown in FIGS. 1A and 1B, the spark plug 100 has such a structure that the entire peripheral surface of the central electrode 3, sometimes minus the forward end portion, is covered with the insulator. With this structure, if the forward end portion of the central electrode 3 expands due to heat, the insulator 2 is pushed outward to spread and receive substantial thermal stress that can potentially cause a problem in durability and other properties. To avoid this problem, it is effective to ensure that the forward end of the central electrode 3 has a structure that makes it less likely to experience thermal expansion than the ground electrode 4. For example, in the case where the internal high heat conducting layer 53 is made of Cu-base material having a large linear expansion coefficient, the larger the diameter of its cross-section, the greater its thermal expansion. Therefore, the length L of the region 55 which is deficient in the internal high heat conducting layer is desirably made somewhat greater in the central electrode 3 than in the ground electrode 4. For example, L/D is preferably set to be 0.65 or more in the central electrode 3.

Figure 6A:
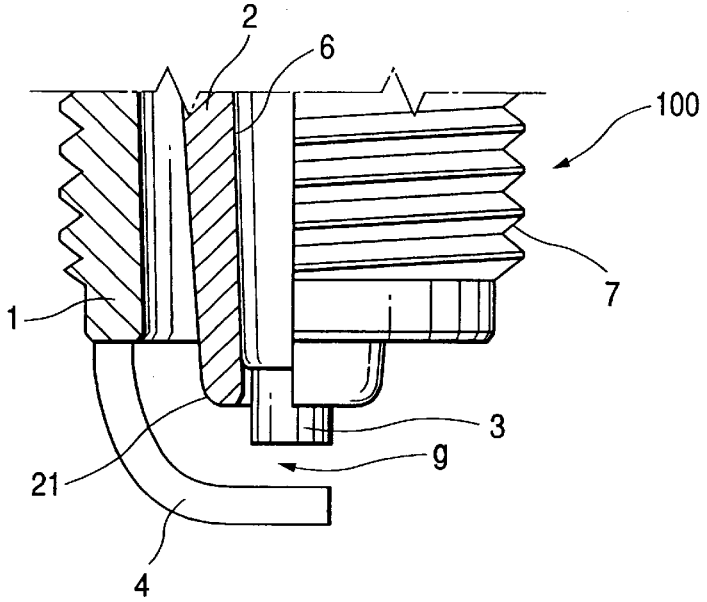
FIG. 6A is a partial front sectional view of a spark plug according to another embodiment of the invention which has no firing portion in the form of noble metal tips.
Figure 6B:
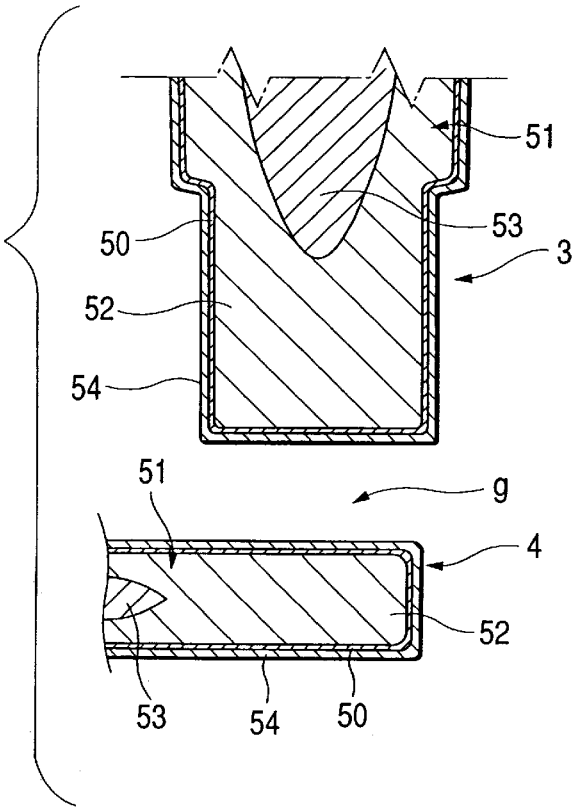
FIGS. 6B and 6C show enlarged essential parts of the spark plug in section.
Figure 6C:
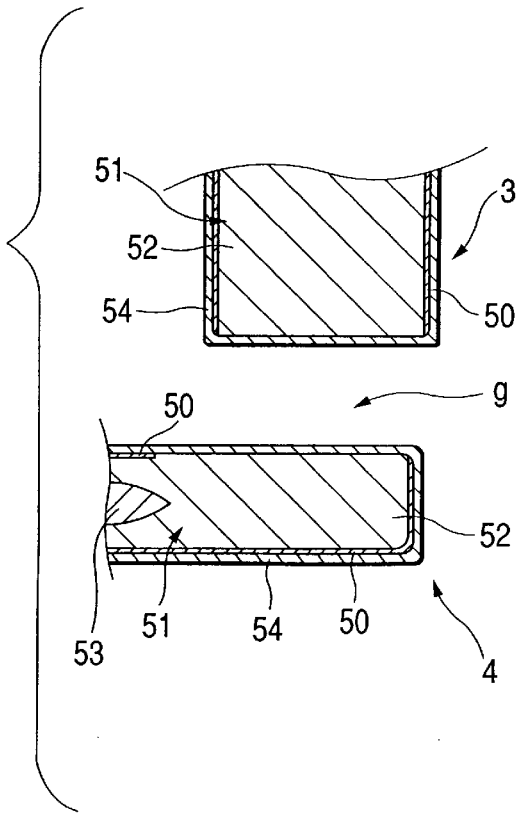
Figure 9:
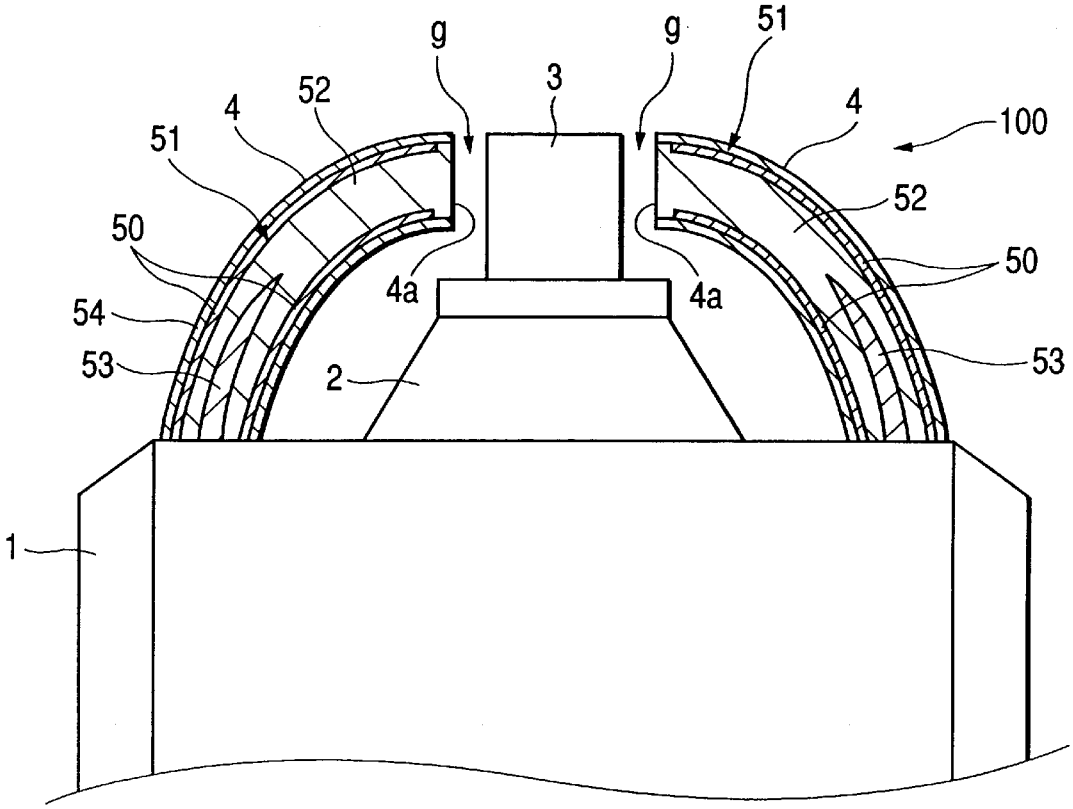
FIG. 9 is a partial front sectional view of a spark plug according to yet another embodiment of the invention, which has no firing portions in the form of noble metal tips.

Various modifications of the spark plug of the invention will now be described. In a first modification, at least one of the opposing firing portions 31 and 32 that are formed by securing a noble metal tip may be omitted. FIGS. 6A and 6B show the case in which both of the firing portions 31 and 32 are omitted. In this case, the spark discharge gap g is formed directly between the tip of the central electrode 3 and a lateral side of the ground electrode 4. Since electrode consumption progresses in the area where the spark discharge gap g is formed between the tip of the central electrode 3 and a lateral side of the ground electrode 4, the high heat conducting layer 50 may be omitted from that area as shown in FIG. 6C. More than one ground electrode 4 may be employed as shown in FIG. 9. In this case, the forward end portion of each ground electrode is bent laterally, and its foremost end surface is brought into a face-to-face relationship with a lateral side of the central electrode 3 to form a spark discharge gap g in the clearance. In this case, the high heat conducting layer 50 is not formed in either the foremost end face of each ground electrode 4 or the corresponding areas of the central electrode 3.

In another modification, the high heat conducting layer 50 may be formed in either one of the central electrode 3 and the ground electrode 4 but not formed in both of these electrodes.

Figure 7A:
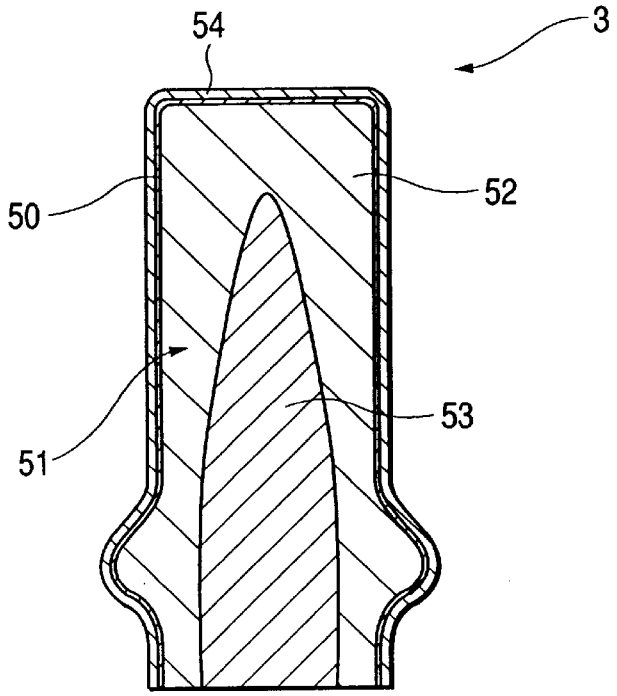
FIGS. 7A and 7B schematically show an exemplary electrode structure in section.
Figure 7B:
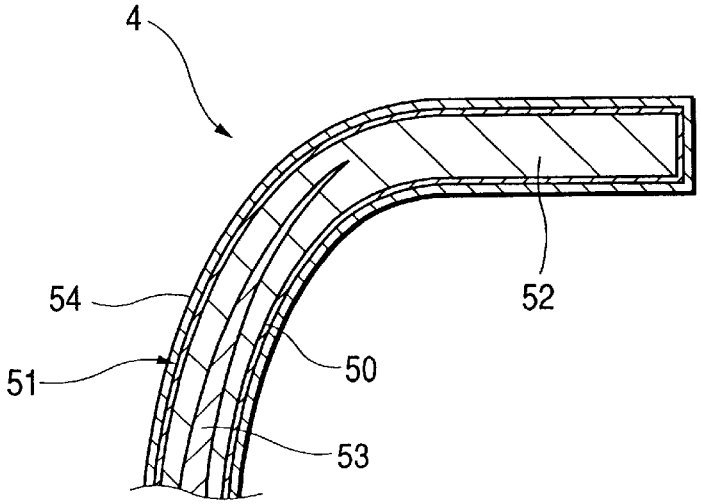
Figure 8A:
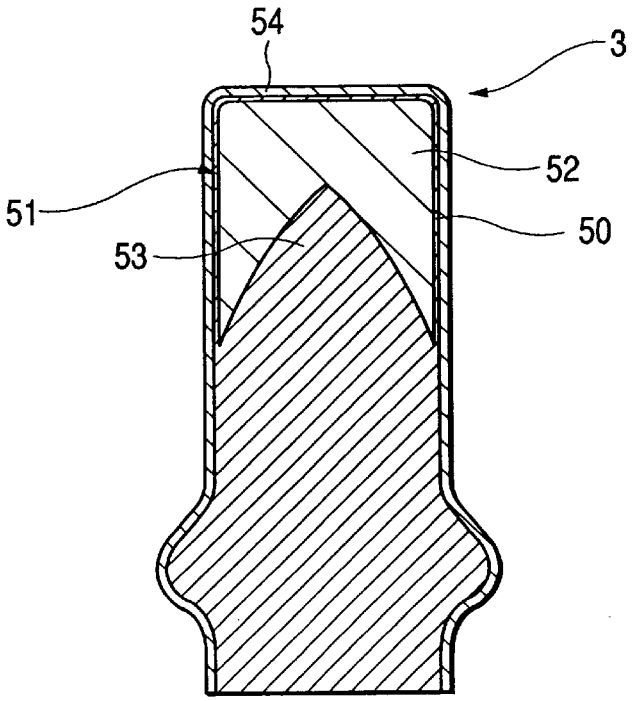
FIGS. 8A and 8B schematically show a first modification of the electrode structure in section.
Figure 8B:
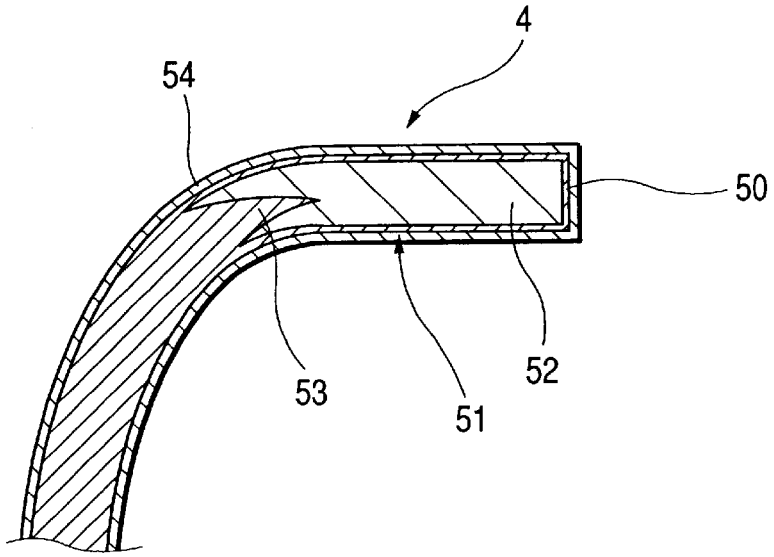

FIGS. 7A and 7B show yet other modifications in which the high heat conducting layer 50 and the internal high heat conducting layer 53 are isolated by the outermost layer 52 not only in the forward end portion of the electrode 3 or 4 (corresponding to the body 3*a* or 4*a* in FIG. 2A), but also in the basal end portion. If desired, the high heat conducting layer 50 and the internal high heat conducting layer 53 may be rendered integral in the basal end portion as shown in FIGS. 8A and 8B.

Figure 10:
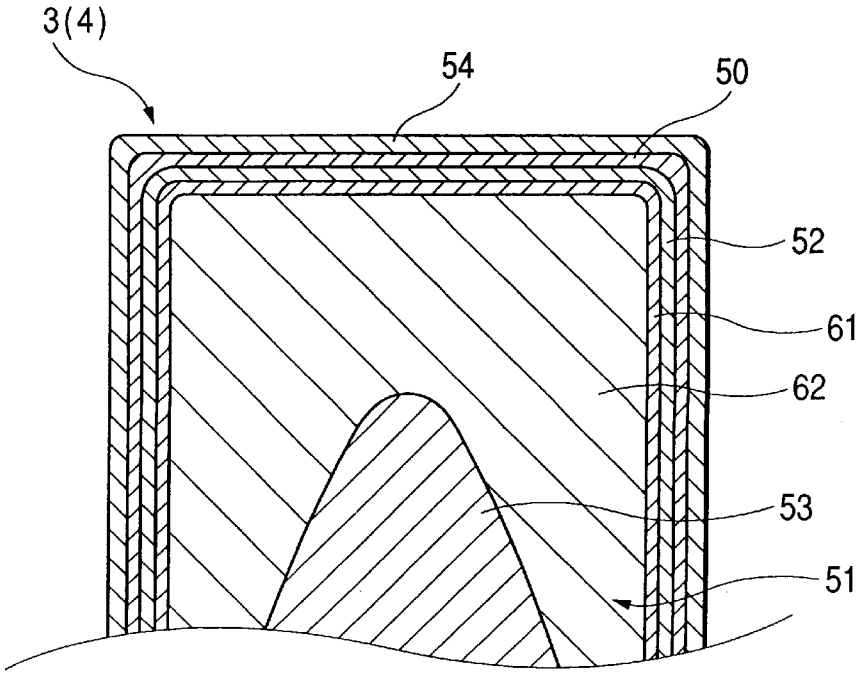
FIG. 10 schematically shows a second modification of the electrode structure in section.

If the heat dissipation from the high heat conducting layer 50 alone is sufficient to achieve the intended heat dissipation, the core 51 need not be of the dual structure described above. Instead, the core 51 may adopt a single-layer structure made of Ni or a Ni alloy. On the other hand, the core 51 may be adapted to consist of three or more layers as shown in FIG. 10. In this multi-layered case, the core 51 has a four-layer structure consisting of the Ni-based outermost layer 52 which is lined with an intermediate high heat conducting layer 61 typically made of a Cu-base material. The intermediate high heat conducting layer 61 is in turn lined with an intermediate Ni-base layer 62. Finally, an internal high heat conducting layer 53 located the most inwardly.

If the firing portion 31 shown in FIGS. 1A and 1B or the opposing firing portion 32 is to be made of an Ir alloy, the alloy may be selected from among the following.

(1) An alloy that is based on Ir and which contains 3 to 50 wt % (exclusive 50 wt %) of Rh. Use of this alloy is effective in suppressing the consumption of the firing portions due to the oxidation and evaporation of the Ir component at elevated temperatures. As a result, a highly durable spark plug is realized.

If the Rh content of this alloy is less than 3 wt %, Rh becomes less effective in suppressing the oxidation and evaporation of Ir, and the firing portions will be consumed at an accelerated rate to eventually reduce the durability of the spark plug. On the other hand, if the Rh content is 50 wt % or more, the melting point of the alloy will decrease, again reducing the durability of the spark plug. In view of these facts, it is recommended that the Rh content be within the stated range, preferably 7 to 30 wt %, more preferably 15 to 25 wt %, and most preferably 18 to 22 wt %.

(2) An alloy that is based on Ir and which contains 1 to 20 wt % (exclusive 20 wt %) of Pt. Use of this alloy is effective in suppressing the consumption of the firing portions due to the oxidation and evaporation of the Ir component at elevated temperatures. As a result, a highly durable spark plug is realized. If the Pt content of this alloy is less than 1 wt %, Pt becomes less effective in suppressing the oxidation and evaporation of Ir, and the firing portions will be consumed at an accelerated rate to eventually reduce the durability of the spark plug. On the other hand, if the Pt content is 25 wt % or more, the melting point of the alloy will decrease, again reducing the durability of the spark plug.

(3) An alloy that is based on Ir and which contains 0.1 to 30 wt % of Rh and 0.1 to 17 wt % of Ru. This alloy is more effective in suppressing the consumption of the firing portions due to the oxidation and evaporation of the Ir component at elevated temperatures. As a result, an even more durable spark plug is realized. If the Rh content of this alloy is less than 0.1 wt %, Rh becomes less effective in suppressing the oxidation and evaporation of Ir, and the firing portions will be consumed at such an accelerated speed that it is no longer possible to produce a non-consumable spark plug. On the other hand, if the Rh content exceeds 30 wt %, the melting point of the alloy will decrease and its resistance to consumption by spark is impaired, again making it difficult to ensure the durability of the spark plug. Therefore, the Rh content of alloy (3) should fall within the stated range.

On the other hand, if the Ru content of the alloy is less than 0.1 wt %, the addition of Ru may not produce the intended effectiveness in suppressing the consumption of the firing portions due to the oxidation and evaporation of Ir. If the Ru content exceeds 17 wt %, the rate of consumption of the firing portions due to spark will increase rather than decrease, and it may no longer be possible to ensure that the spark plug will have the intended durability. Considering these facts, it is recommended that the Ru content lie within the stated range, preferably 0.1 to 13 wt %, and more preferably 0.5 to 10 wt %.

(4) Whichever of the alloys (1) to (3) is to be used as a tip composing material, oxides (inclusive of complex oxides) of metallic elements of group 3A (so-called "rare earth elements") and group 4A (Ti, Zr and Hf) of the periodic table may additionally be contained in amounts of 0.1 to 15 wt %. The addition of such oxides is even more effective in suppressing the consumption of the firing portions due to the oxidation and evaporation of the Ir component. If the content of the oxides is less than 0.1 wt %, their addition will not be highly effective in preventing the oxidation and evaporation of Ir. On the other hand, if the content of the oxides exceeds 15 wt %, the tip's resistance to thermal impact is reduced. Also, when the tip is being secured to the electrodes by welding or some other suitable method, defects such as cracking may sometimes occur. An advantageous example of the oxides is $Y_2O_3$, but other oxides such as $LaO_3$, $ThO_2$ and $ZrO_2$ may also be used with preference.

EXAMPLES

Samples of the spark plug 100 (see FIG. 1B) were prepared in the following manner. Using disks of tip 0.7 mm in diameter and 0.5 mm thick, the firing portion 31 was prepared from an Ir alloy (Ir-5 wt % Pt), and the opposing firing portion 32 was prepared from a Pt-20 wt % Ni alloy. The spark discharge gap g had a width of 1.1 mm. The ground electrode 4 had a rectangular axial cross-section measuring 1.5 mm×2.8 mm. The outermost layer 52 of the core 51 was composed of a Ni alloy (Inconel 600) and the internal high heat conducting layer 53 was composed of Cu as a single substance metal. The thickness t (see FIG. 2A) of the high heat conducting layer 50 was varied over the range of 0 to 0.5 mm (0 mm was for a comparative sample having no high heat conducting layer). The thickness A (see FIG. 2A) of the outer coating layer 54 was varied in the range of 0.05 to 0.5mm. The value of the aforementioned L was set at about 1.5 mm and L/D was 0.65.

The central electrode 3 was a cylinder with its tip formed as shown in FIG. 2A. The outermost layer 52 of the core 51 was made of a Ni alloy (Incornal 600) and the internal high heat conducting layer 53 was made of Cu as a single substance. The thickness of the high heat conducting layer 50 was set at 0.15 mm and the thickness of the outer coating layer 54 at 0.2 mm. The outside diameter D of the region 55 which was deficient in the internal high heat conducting layer was set at 2.5 mm and its length L was set at 2 mm. Hence, L/D was 0.8.

Figure 11:
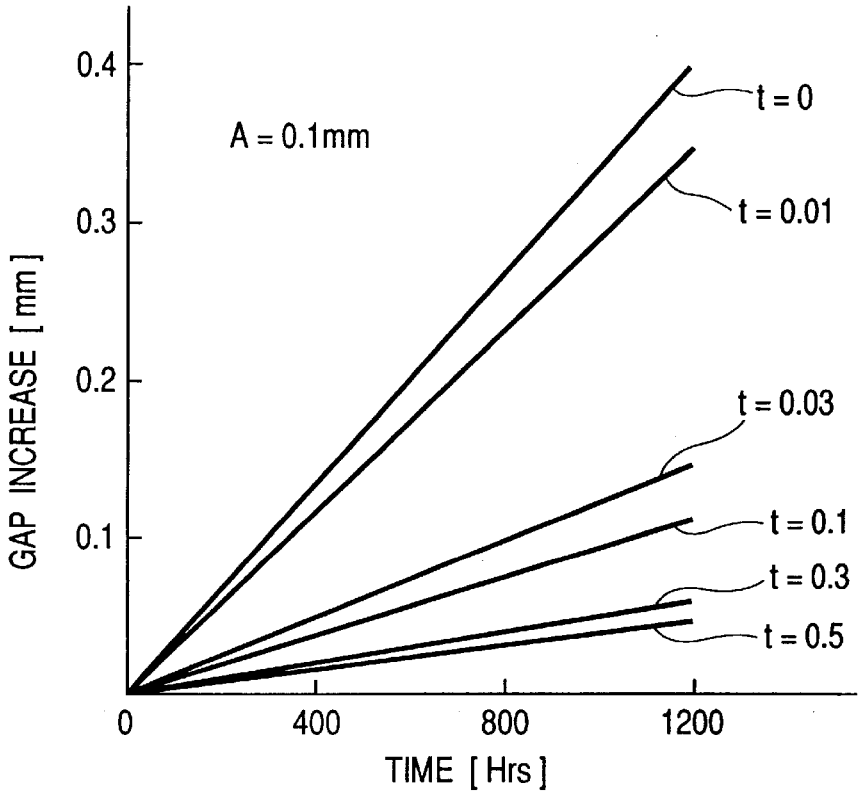
FIG. 11 is a graph showing the results of the first experiment conducted in the Example of the invention.
Figure 12:
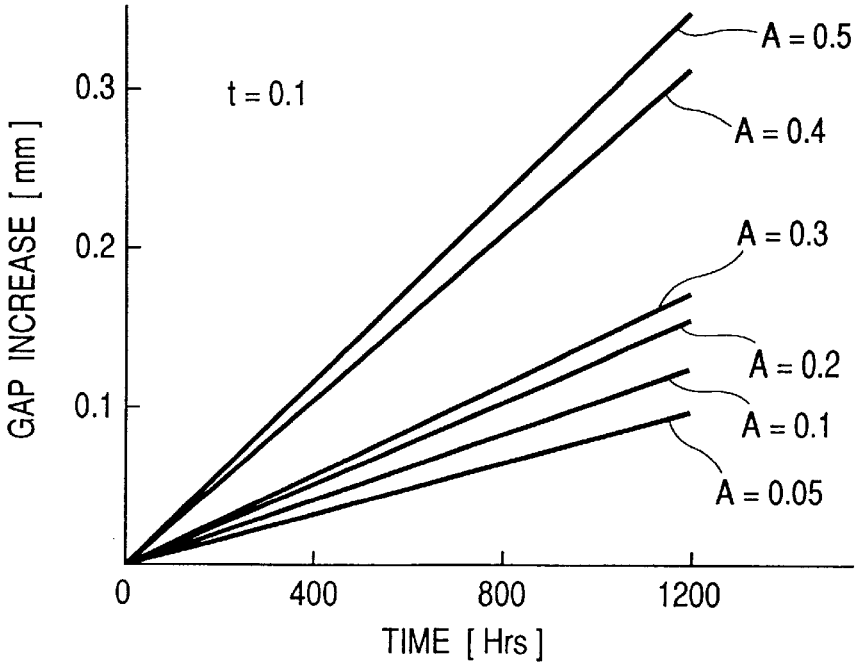
FIG. 12 is a graph showing the results of the second experiment conducted in the Example.

Each of the thus prepared samples of spark plug was subjected to a performance test under the following conditions. The spark plugs were installed on a 6-cylinder gasoline engine (displacement: 3000 cc), which was continuously operated for 1,200 hours at full throttle and at 5000 rpm (with the central electrode heated to about 900° C.). The enlargement of the spark discharge gap g in the spark plug being tested was measured over time and the results are shown in FIGS. 11 and 12. FIG. 11 shows the results of the case in which the thickness A of the outer coating layer 54 was fixed at 0.1 mm and the thickness t of the high heat conducting layer 50 was varied. Obviously, when t was equal to or greater than 0.03 mm, the enlargement of the spark discharge gap g was small enough to prolong the endurance of the spark plug being tested. This is because the thickness of the high heat conducting layer 50 was increased to promote heat dissipation.

FIG. 12 shows the results of the case in which the thickness t of the high heat conducting layer 50 was fixed at 0.1 mm and the thickness A of the outer coating layer 54 was varied. Obviously, when A was equal to or smaller than 0.3 mm, the enlargement of the spark discharge gap g was small enough to prolong the endurance of the spark plug being tested. This was because the smaller the thickness A of the outer coating layer 54, the more efficient the progress of heat dissipation from the high heat conducting layer 50. The enlargement of the spark discharge gap g further decreased when A was smaller than 0.2 mm.

Other samples of spark plug were prepared in the same manner as described above and they were subjected to an endurance test under the following heat cycle conditions. The spark plugs were installed on the same type of gasoline engine as described above, which was operated for 1 min. at full throttle and at 5000 rpm, and then allowed to idle for 1 min. This cycle was repeated for 100 hours. Thereafter, the appearance of the central electrode 3 and the ground electrode 4 in each spark plug being tested was visually checked and the result is shown in Table 1 below.

TABLE 1

| A (mm) | t (mm) | Evaluation |
|---|---|---|
| 0.1 | 0.5 | NG with expansion electrodes |
| 0.1 | 0.3 | OK |
| 0.1 | 0.1 | OK |

TABLE 1-continued

| A (mm) | t (mm) | Evaluation |
|---|---|---|
| 0.05 | 0.1 | OK |
| 0.03 | 0.1 | NG with expansion electrodes |

Obviously, when the thickness A of the outer coating layer 54 was less than 0.05 mm or when the thickness t of the high heat conducting layer 50 exceeded 0.3 mm, the electrodes expanded. This expansion was probably due to the development of thermal stress.

The entire disclosure of each and every foreign patent application from which the benefit of foreign priority has been claimed in the present application is incorporated herein by reference, as if fully set forth.

While only certain embodiments of the invention have been specifically described herein, it will apparent that numerous modifications may be made thereto without departing from the spirit and scope of the invention.

What is claimed is:

1. A spark plug comprising:

a central electrode;

an insulator provided exterior to said central electrode;

a metal shell provided exterior to said insulator; and a ground electrode opposing said central electrode;

wherein at least one of said central electrode and said ground electrode has a multi-layered structure comprising a core having an outermost layer, and a high heat conducting layer covering at least part of a surface of the core, having a thickness within a range of 0.03 to 0.3 mm, and being more heat conductive than the outermost layer of the core that is in contact with the high heat conducting layer.

2. The spark plug according to claim 1, wherein the high heat conducting layer comprises a material selected from the group consisting of Cu, Ag, Au and Ni.

3. The spark plug according to claim 1, wherein an outside of the high heat conducting layer is covered with an outer coating layer that is more corrosion-resistant than the high heat conducting layer.

4. The spark plug according to claim 3, wherein the outer coating layer is made of a material having a smaller linear expansion coefficient than the high heat conducting layer.

5. The spark plug according to claim 3, wherein the outer coating layer is made of a Ni alloy.

6. The spark plug according to claim 3, wherein a thickness of the outer coating layer is within a range of 0.05 to 0.3 mm.

7. The spark plug according to claim 1, wherein the core comprises a plurality of layers arranged such that adjacent layers have different linear expansion coefficients.

8. A spark plug comprising:

a central electrode;

an insulator provided exterior to said central electrode;

a metal shell provided exterior to said insulator; and a ground electrode opposing said central electrode;

wherein at least one of said central electrode and said ground electrode has a multi-layered structure comprising a core having an outermost layer, a high heat conducting layer covering at least part of a surface of the core and being more heat conductive than the outermost layer of the core that is in contact with the high heat conducting layer, and an outer coating layer covering an outside of the high heat conducting layer, having a thickness within a range of 0.05 to 0.2 mm, and being more corrosion-resistant than the high heat conducting layer.

9. The spark plug according to claim 8, wherein the core comprises a plurality of layers arranged such that adjacent layers have different linear expansion coefficients.

10. The spark plug according to claim 9, wherein at least one layer of the core, except the outermost layer, is an internal high heat conducting layer that is more heat conductive than the outermost layer.

11. The spark plug according to claim 10, wherein said at least one of said central electrode and said ground electrode is referred to as a multi-layered electrode; and wherein an internal high heat conducting layer deficient region is defined as a region where S2/S1 is less than 0.13, and is formed in a specified length in the forward end portion of the multi-layered electrode, S1 being an axial cross-sectional area of the multi-layered electrode, and S2 being an axial cross-sectional area of the internal high heat conducting layer.

12. The spark plug according to claim 11, wherein L/D is at least 0.55, L being the length of the internal high heat conducting layer deficient region and D being an axial cross-section dimension of the multi-layered electrode at a position where the internal high heat conducting layer deficient region is present.

* * * * *

UNITED STATES PATENT AND TRADEMARK OFFICE

CERTIFICATE OF CORRECTION

PATENT NO. : 6,121,719
DATED : September 19, 2000
INVENTOR(S) : Wataru Matsutani et al.

It is certified that error appears in the above-identified patent and that said Letters Patent is hereby corrected as shown below:

Claim 11,
Delete lines 2 and 3;
Line 4, delete "wherein";
Line 7, change "the multi-layered electrode" to -- said at least one of said central electrode and said ground electrode --;
Line 8, change "the multi-layered electrode" to --said at least one of said central electrode and ground eletrode --;

Claim 12,
Line 4, change "the multi-layered electrode" to -- said at least one of said central electrode and said ground electrode --.

Signed and Sealed this

Twentieth Day of November, 2001

*Attest:*

Nicholas P. Godici

*Attesting Officer*

NICHOLAS P. GODICI
*Acting Director of the United States Patent and Trademark Office*